US010728643B2

(12) United States Patent
Solak

(10) Patent No.: US 10,728,643 B2
(45) Date of Patent: Jul. 28, 2020

(54) SOUND CONVERSION DEVICE

(71) Applicant: David M. Solak, Seven Hills, OH (US)

(72) Inventor: David M. Solak, Seven Hills, OH (US)

( * ) Notice: Subject to any disclaimer, the term of this patent is extended or adjusted under 35 U.S.C. 154(b) by 0 days.

(21) Appl. No.: 16/146,504

(22) Filed: Sep. 28, 2018

(65) Prior Publication Data

US 2020/0107091 A1 Apr. 2, 2020

(51) Int. Cl.
*H04R 1/04* (2006.01)
*G09G 3/32* (2016.01)

(52) U.S. Cl.
CPC ..... *H04R 1/04* (2013.01); *G09G 3/32* (2013.01)

(58) Field of Classification Search
CPC ..... H04R 1/04; G09G 3/32
See application file for complete search history.

(56) References Cited

U.S. PATENT DOCUMENTS 3,240,099 A * 3/1966 Irons ..... A63J 17/00 84/464 R
3,540,343 A * 11/1970 Rifkin ..... A63J 17/00 84/464 R
3,582,671 A * 6/1971 Ott ..... A63J 17/00 307/117
3,720,939 A 3/1973 Polanek et al.
4,040,436 A 8/1977 Caldwell
4,408,308 A 10/1983 Smith et al.
4,441,860 A 4/1984 Tsujimoto
4,476,554 A * 10/1984 Smith ..... H03K 17/28 307/117
4,791,536 A * 12/1988 James ..... A44C 15/0015 362/104
4,796,017 A 1/1989 Merenda
4,825,587 A 5/1989 Stancil
4,930,252 A 6/1990 Krause et al.
4,967,508 A 11/1990 Reynolds
5,056,399 A * 10/1991 Hornstein ..... A63J 17/00 340/815.45
5,318,267 A 6/1994 Rast
5,365,149 A * 11/1994 Blakeslee ..... H05B 47/12 315/200 A (Continued)

FOREIGN PATENT DOCUMENTS

CN 202327901 * 11/2011 ..... F21S 8/00
CN 202327901 * 7/2012 ..... F21S 8/00

(Continued)

OTHER PUBLICATIONS

Non Final Office Action dated May 25, 2010 U.S. Appl. No. 10/894,902.

*Primary Examiner* — Oyesola C Ojo
(74) *Attorney, Agent, or Firm* — Curatolo Sidoti Co., LPA; Salvatore A. Sidoti; Floyd Trillis, III

(57) ABSTRACT

A sound conversion device comprising (i) a housing having an electrical circuit contained therein for receiving and converting one or more audio signals into one or more first DC voltages, wherein the electrical circuit includes a relay switch that is activated by the one or more first DC voltages, wherein in its activated state the relay switch provides an alternating current (AC) voltage or a second DC voltage and (ii) a light display in electrical communication with the electrical circuit, wherein the light display turns on and off in response to the received one or more audio signals.

17 Claims, 4 Drawing Sheets

(56) References Cited

U.S. PATENT DOCUMENTS

| | | | | |
|---|---|---|---|---|
| 5,425,199 | A | 6/1995 | Sofy | |
| 5,450,067 | A | 9/1995 | Wang | |
| 5,473,837 | A | 12/1995 | Skoczylas et al. | |
| 5,590,865 | A | 1/1997 | Odom, Jr. | |
| 5,744,715 | A | 4/1998 | Gerome | |
| 5,791,083 | A | 8/1998 | Giangrossi | |
| 5,813,110 | A * | 9/1998 | Arntson | B21J 15/24 29/243.53 |
| 5,818,342 | A * | 10/1998 | Solomon | A63J 17/00 340/815.46 |
| 5,867,929 | A | 2/1999 | Jung et al. | |
| 5,937,574 | A | 8/1999 | Jacques | |
| 5,969,620 | A | 10/1999 | Okulov | |
| 6,087,946 | A | 7/2000 | Menard, Jr. | |
| 6,145,755 | A | 11/2000 | Feltz | |
| 6,164,792 | A * | 12/2000 | Nakagome | B60Q 3/88 362/276 |
| 6,405,480 | B1 | 6/2002 | Martin | |
| 6,765,496 | B2 * | 7/2004 | Dayan | G08B 1/08 340/903 |
| 6,997,642 | B2 | 2/2006 | Bishop, Jr. | |
| 7,110,862 | B2 | 9/2006 | Park | |
| 7,147,014 | B2 | 12/2006 | Chien | |
| 7,228,190 | B2 * | 6/2007 | Dowling | H05B 47/12 700/94 |
| 7,471,206 | B1 | 12/2008 | Ellerman | |
| 7,484,703 | B2 | 2/2009 | Krinner | |
| 7,736,496 | B2 | 6/2010 | DeGiacomo | |
| 7,765,736 | B1 | 8/2010 | Lloyd | |
| 7,886,483 | B2 | 2/2011 | Solak | |
| 8,132,360 | B2 | 3/2012 | Jin et al. | |
| 8,546,674 | B2 | 10/2013 | Kurihara et al. | |
| 9,941,082 | B2 | 4/2018 | Solak | |
| 2002/0017055 | A1 | 2/2002 | Nalbandian et al. | |
| 2007/0026728 | A1 | 2/2007 | Mak | |
| 2008/0167868 | A1 | 7/2008 | Kanevsky et al. | |
| 2010/0313471 | A1 | 12/2010 | Middaugh | |
| 2012/0000535 | A1 | 1/2012 | Poyner et al. | |
| 2013/0269503 | A1 * | 10/2013 | Liu | G10H 1/0008 84/464 R |
| 2014/0174376 | A1 * | 6/2014 | Touchton | G08B 23/00 119/719 |
| 2017/0127171 | A1 * | 5/2017 | Haworth | H04R 19/04 |

FOREIGN PATENT DOCUMENTS

| | | | |
|---|---|---|---|
| CN | 206658315 | * 11/2017 | H05B 33/08 |
| CN | 108847854 | * 11/2018 | H04B 1/04 |

* cited by examiner

SOUND CONVERSION DEVICE

TECHNICAL FIELD

The present disclosure is directed to a sound conversion device and a method for converting a sound signal. This disclosure is more particularly directed to a device that converts an audio signal into a visual signal and a method for converting an audio signal into a visual signal.

BACKGROUND

A variety of methods have been proposed for converting an audio signal into a visual signal. Typically, there is a substantial inherent time delay between the occurrence of the audio stimulus and the appearance of a corresponding visual response. Known devices fail to provide a visual output which varies in intensity and responds in real time to a received audio input signal. Known devices are also relatively expensive and difficult to manufacture. Therefore, it can be appreciated that there exists a continuing need for a new and improved sound conversion device.

DETAILED DESCRIPTION

Figure 1:
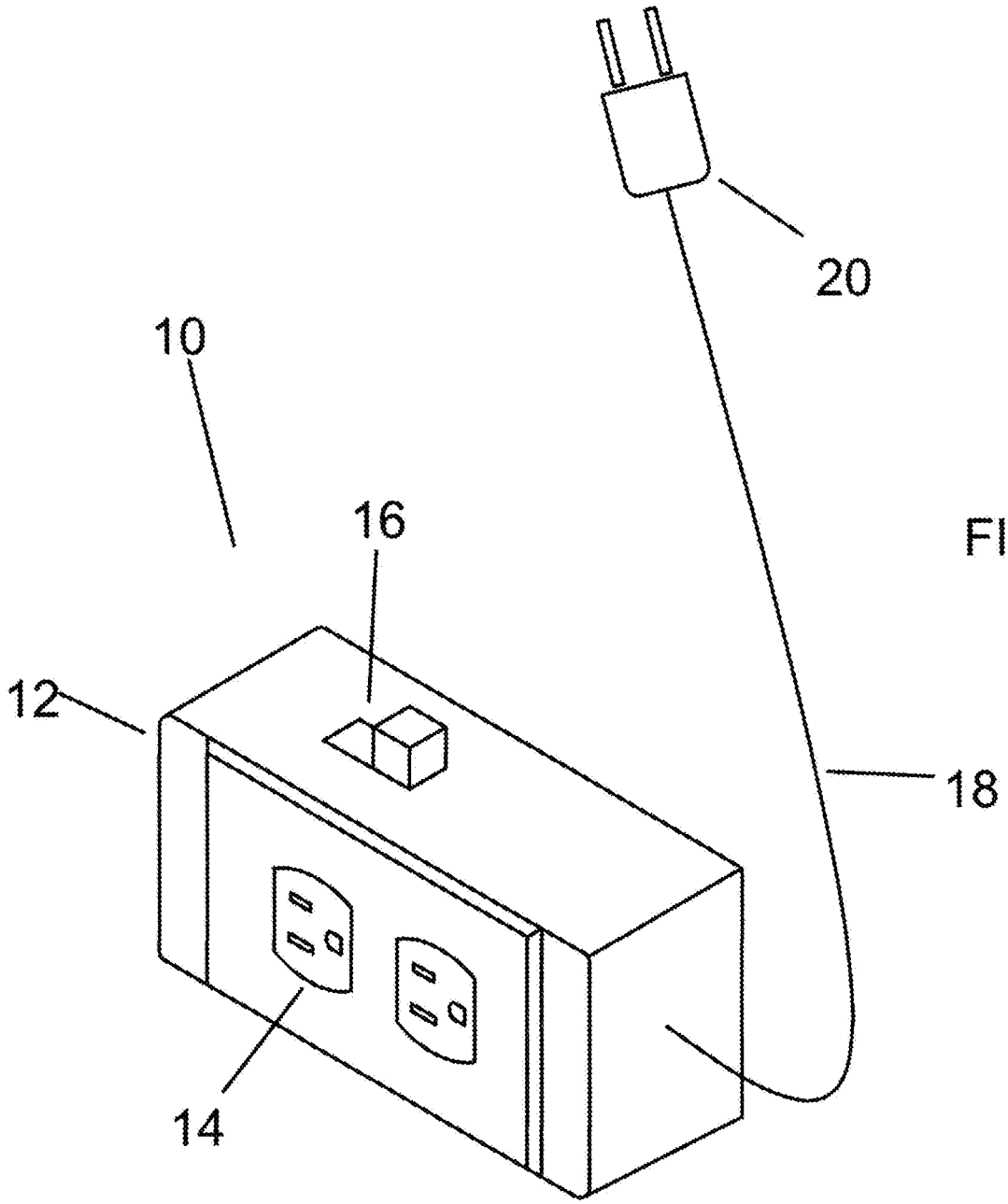
FIG. 1 is a front perspective view of one illustrative embodiment of the sound conversion device comprising i) a housing having an electrical circuit contained therein, wherein at least one surface of the housing incorporates a 110-120 VAC outlet which permits a light display to be plugged into the sound conversion device, ii) a switch to interrupt or restore electrical current and iii) an electrical cord and plug adapted to be inserted into an electrical outlet, such as a wall outlet.

According to certain embodiments, the sound conversion device comprises (i) a housing having an electrical circuit contained therein for receiving and converting one or more audio signals into one or more first direct current (DC) voltages, wherein said electrical circuit includes an optocoupler relay that is activated by said one or more first DC voltages, wherein in its activated state the optocoupler relay provides an alternating current (AC) voltage or a second DC voltage and (ii) a light display in electrical communication with the electrical circuit, wherein said light display turns on and off in response to the one or more received audio signals.

According to certain embodiments, the sound conversion device comprises (i) a housing having an electrical circuit contained therein for receiving and converting one or more audio signals into one or more first direct current (DC) voltages, wherein said electrical circuit includes an electromechanical relay that is activated by said one or more first DC voltages, wherein in its activated state the electromechanical relay provides an alternating current (AC) voltage or a second DC voltage and (ii) a light display in electrical communication with the electrical circuit, wherein said light display turns on and off in response to the one or more received audio signals.

Also disclosed is an electrical circuit that receives and converts one or more audio signals into one or more first direct current (DC) voltages. According to certain embodiments, the electrical circuit comprises an optocoupler relay that is activated by one or more first DC voltages, wherein in its activated state the optocoupler relay provides an alternating current (AC) voltage or a second DC voltage that powers a light display that is in electrical communication with the electrical circuit, wherein the light display turns on and off in response to the one or more received audio signals.

According to certain embodiments, the electrical circuit for receiving and converting one or more audio signals into DC voltage is at least partially contained within a housing. The geometric shape of the housing is not limited. According to certain embodiments, the housing is substantially rectangular. According to certain embodiments, the housing is substantially square. According to certain embodiments, the housing includes an elongated electrical wire terminating in a plug. The plug is adapted to be inserted into an electrical outlet, such as a wall outlet, to provide a source of electrical power to the sound conversion device. According to certain embodiments, the housing comprises an integrated plug adapted to be inserted directly into an electrical outlet, such as a wall outlet. According to certain embodiments, at least one surface of the housing of the sound conversion devices incorporates a 110-120 VAC outlet which permits a light display to be plugged into the sound conversion device.

The electrical circuit contained within in the housing controls the activation of a relay switch which generates a visually perceptible signal in response to an audio input signal. When an audio signal is received by a microphone, an electrical signal is created in the electrical circuit which activates the relay switch. Activating the relay switch charges an AC or DC powered light display that is in electrical communication with the disclosed sound conversion device to produce a visual signal. Once an audio signal is no longer received by the microphone, the relay switch is deactivated. Consequently, the visual signal turns off. The sound conversion device is capable of controlling a wide variety of light displays, ranging from decorative light strings to reading lamps of all shapes and sizes. The present disclosure also provides a sound conversion device which is relatively low in cost and easy to manufacture.

According to certain embodiments, the housing of the sound conversion device comprises one or more apertures to allow an audio signal to be received by the electrical circuit that is at least partially contained within the housing. According to certain embodiments, an audio amplifier is positioned at or near one or more apertures of the housing to receive an audio signal. According to certain embodiments, the audio amplifier comprises a microphone to receive an audio signal. A wide variety of suitable microphones are commercially available from CUI, Inc. (Tualatin, Oreg.), Soberton, Inc. (Minneapolis, Minn.), and PUI Audio, Inc. (Dayton, Ohio). The audio input of the microphone is processed by the electrical circuit described herein. According to certain embodiments, a microphone and electrical circuit control a relay switch, which in turn controls a light display that is in electrical communication with the sound conversion device. The luminosity of the light display fluctuates in response to a plurality of received audio signals.

According to certain embodiments, the electrical circuit contained within the sound conversion device receives an audio signal via a microphone and converts the audio signal into an electrical signal. According to certain embodiments, the audio signal is converted to DC voltage. According to certain embodiments, the DC voltage pulsates between 0 volts and 9 volts based on the presence or absence of one or more received audio signals. In the absence of an audio signal, no DC voltage is created in the electrical circuit of the sound conversion device. According to certain embodiments, about 1 to about 9V DC is created in the presence of one or more suitable audio signals.

It should be understood that when a range of values is described in the present disclosure, it is intended that any and every value within the range, including the end points, is to be considered as having been disclosed. For example, the disclosure of "a range of from about 1 volts to about 9 volts" is to be read as indicating each and every possible value between 1 and 9. It is to be understood that the inventor appreciates and understands that any and all values within the disclosed ranges are to be considered to have been specified, and that the inventor has possession of the entire range and all the values within the range.

In the present disclosure, the term "about" used in connection with a value is inclusive of the stated value and has the meaning dictated by the context. For example, the term "about" includes at least the degree of error associated with the measurement of the particular value. One of ordinary skill in the art would understand the term "about" is used herein to mean that an amount of "about" of a recited value results in the desired degree of effectiveness in the devices and/or methods of the present disclosure.

In the present disclosure, the term "substantially" refers to a degree of deviation that is sufficiently small so as to not measurably detract from the identified property or circumstance. The exact degree of deviation allowable may in some cases depend on the specific context.

According to certain embodiments, the electrical circuit and microphone are powered by a DC power supply. According to certain embodiments, the electrical circuit and/or microphone are powered by a battery. According to certain embodiments, the electrical circuit and/or microphone are powered by a 9-volt battery. According to certain embodiments, the electrical circuit and/or microphone are powered by a rectifier. According to certain embodiments, the rectifier circuit converts an AC signal into a DC signal. According to certain embodiments, the rectifier circuit filters AC sine waves into flatter DC patterns. A wide variety of suitable rectifiers are commercially available from Central Semiconductor Corp. (Hauppauge, N.Y.), Bourns, Inc. (Riverside, Calif.), and Comchip Technology Co., Ltd. (Taipei, Taiwan).

According to certain embodiments, the electrical circuit contained within the housing of the sound conversion device powers a relay switch. The relay switch is switched on and off by pulsating DC voltage that is created by a plurality of audio signals received by a microphone. When the relay switch is switched on, it controls AC or DC voltage which powers a light display. According to certain embodiments, the pulsating 1-9V DC is capable of charging a higher or lower DC voltage light display which turns on and off in response to a plurality of received audio signals.

According to certain embodiments, the relay switch comprises an optocoupler. Optocouplers provide a means of isolating two electrical circuits that communicate signals with each other but cannot be electrically connected. Optocouplers are able to send signals from one circuit to a second circuit using light instead of wires by incorporating a Light Emitting Diode (LED) to generate a light signal from an electrical signal and a light detector to receive the light signal and convert it back into an electrical signal.

According to certain embodiments, the optocoupler comprises a solid-state relay. According to certain embodiments, the optocoupler comprises a solid-state relay with AC or DC control with a resistive or inductive load. A solid-state relay is an electronic switching device that switches on or off when an external voltage is applied across its control terminals. A solid-state relay consists of a sensor which responds to an input, a solid-state electronic switching device which switches power to the load circuitry, and a coupling mechanism to enable the input to activate the switch without mechanical parts. The solid-state relay may switch either AC or DC to the load.

Solid-state relays utilize optical semiconductors called photocouplers to isolate input and output signals. Photocouplers change electric signals into optical signals and relay the signals through a space, thus fully isolating the input and output sections while relaying the signals at high speed. Solid-state relays include transistors and thyristors (e.g., silicone controlled rectifiers, diodes, triacs, diacs, etc.). Solid-state relays have fast switching speeds and are totally silent during operation. A solid-state relay exhibits an increased lifetime, even if it is activated many times, as there are no moving parts to wear and no contacts to pit or build up carbon. Solid-state relays are also much less sensitive to storage and operating environment factors such as mechanical shock, vibration, humidity, and external magnetic fields. Solid-state relays also have a relatively small and slim profile, allowing tighter packing. A wide variety of suitable solid-state relays are commercially available from Crydom Inc. (San Diego, Calif.), Panasonic Corporation (Newark, N.J.), Omron Corporation (Hoffman Estates, Ill.), and Amperite Company (North Bergen, N.J.).

According to certain embodiments, the relay switch comprises an electromechanical relay. A wide variety of suitable electromechanical relays are commercially available from Panasonic Corporation (Newark, N.J.), Omron Corporation (Hoffman Estates, Ill.), and Honeywell International Inc. (Morris Plains, N.J.).

According to certain embodiments, the electrical circuit comprises one or more fuses to protect from overloads and transients in electrical power. According to certain embodiments, the least one fuse can be resettable or a one-time action type. According to certain embodiments, a button is positioned on an exterior surface of the housing that is capable of resetting the fuse. According to certain embodiments, the fuse is a current-limiting fuse that provides extremely fast opening while restricting let-through current far below the fault current that could destroy a semiconductor. According to certain embodiments, the fuse comprises an I2T semiconductor fuse. A wide variety of suitable fuses are commercially available from Littlefuse, Inc. (Chicago, Ill.), the Bussman Series by Eaton Corporation PLC (Dublin, Ireland), and Mersen USA LLC (Newburyport, Mass.).

According to certain embodiments, the electrical circuit comprises a sensitivity adjuster. The sensitivity adjuster allows the threshold value for converting a received audio signal into an electrical signal to be selectively controlled or adjusted. According to certain embodiments, the sensitivity adjuster comprises a trimmer. According to certain embodiments, the trimmer comprises at least one of a variable resistor (potentiometer), variable capacitor or trimmable inductor. According to certain embodiments, the sensitivity adjuster is in electrical communication with a microphone to receive one or more audio signals. The sensitivity adjuster forms an adjusted signal that is output to the relay switch. According to certain embodiments, the sensitivity adjuster is adjusted to detect low and high volume audio signals.

According to certain embodiments, the sensitivity adjuster is adjusted to detect low volume audio signals. Without limitation, and only by way of illustration, when the sensitivity adjuster is adjusted to a low volume setting, the sound conversion device is capable of detecting normal speech (about 50 to about 60 decibels) from a distance of about 50 to about 100 feet. According to certain embodiments, the sensitivity adjuster is adjusted to detect high volume audio signals. Without limitation, and only by way of illustration, when the sensitivity adjuster is adjusted to a high volume setting, the sound conversion device is capable of detecting a jackhammer (about 130 decibels) from a distance of about 1000 feet or greater. According to certain embodiments, the sensitivity adjuster can be selectively adjusted outside of the housing of the sound conversion device. A wide variety of suitable potentiometers or sensitivity adjusters are commercially available from Bourns, Inc. (Riverside, Calif.), CTS Corporation (Lisle, Ill.), and Precision Electronic Components Ltd. (Ontario, Canada).

According to certain embodiments, the sound conversion device comprises a switch to interrupt or restore electric current to the device. According to certain embodiments, the sound conversion device comprises at least one electromechanical switch. According to certain embodiments, the switch includes selectable operation modes. A first position may be selected in which the sound conversion device is operable to turn the light display on continuously, regardless of the presence or absence of one or more received audio signals. A second position may be selected in which the sound conversion device is operable to turn the light display on and off in response to a plurality of received audio signals. A third position may be selected in which the sound conversion device is not operable to turn the light display on and off in response to a plurality of received audio signals. A wide variety of suitable switches are commercially available from C&K (Newton, Mass.), CW Industries (Southampton, Pa.) and Grayhill, Inc. (La Grange, Ill.).

Also disclosed is a method for converting one or more audio signals into one or more visually perceptible signals comprising i) converting one or more audio signals into one or more first DC voltages via an electrical circuit, wherein the electrical circuit comprises an optocoupler to relay said one or more first DC voltages into an AC voltage or a second DC voltage, ii) providing a source of electrical power to the optocoupler, and iii) using said AC voltage or second DC voltage to power a light display that turns on and off in response to the received one or more audio signals.

The sound conversion device is readily understood when read in conjunction with illustrative FIGS. 1-4. It should be noted that the sound conversion device is not limited to any of the illustrative embodiments shown in the figures, but rather should be construed in breadth and scope in response to the disclosure provided herein.

FIG. 1 is a front perspective view of one illustrative embodiment of the sound conversion device 10. The sound conversion device 10 comprises a housing 12 having an electrical circuit (not shown) contained therein. The housing 12 comprises a switch 16 to interrupt or restore electric current. Sound conversion device 10 includes an elongated electrical connection 18 terminating in plug 20. Plug 20 is adapted to be inserted into an electrical outlet (not shown), such as a wall outlet, to provide a source of electrical power to sound conversion device 10. Sound conversion device 10 further comprises a 110-120 VAC outlet 14 which permits a light display (not shown) to be plugged into sound conversion device 10.

Figure 2:
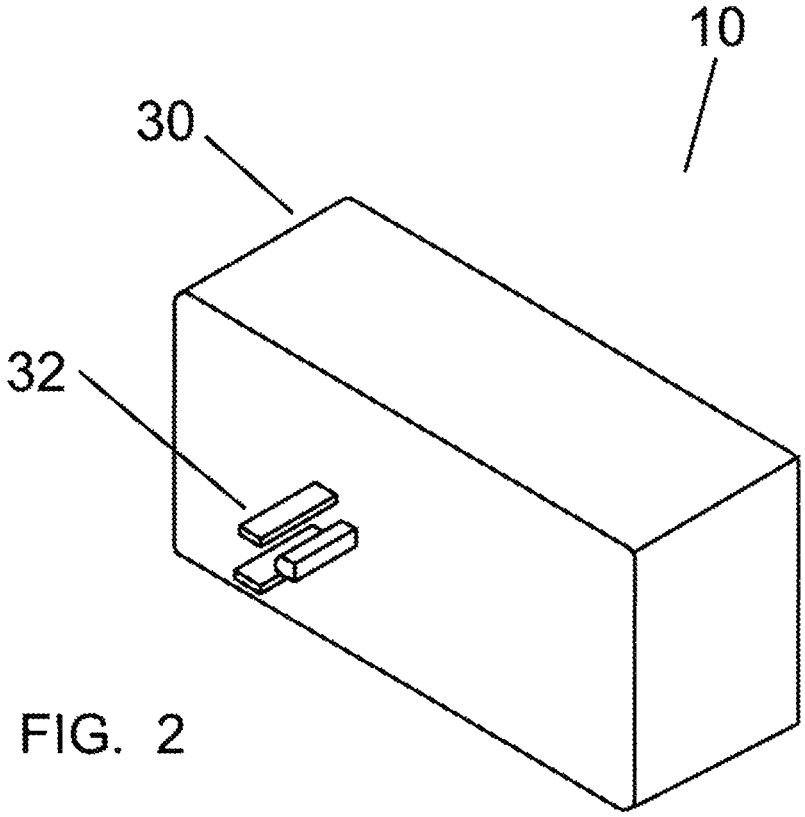
FIG. 2 is a back perspective view of one illustrative embodiment of the sound conversion device comprising an integrated housing having an electrical circuit contained therein, wherein the integrated housing is adapted to be directly inserted into an electrical outlet, such as a wall outlet.

FIG. 2 is a back perspective view of one illustrative embodiment of sound conversion device 10 comprising a housing 30 having an integrated plug 32 adapted to be directly inserted into an electrical outlet, such as a wall outlet.

Figure 3:
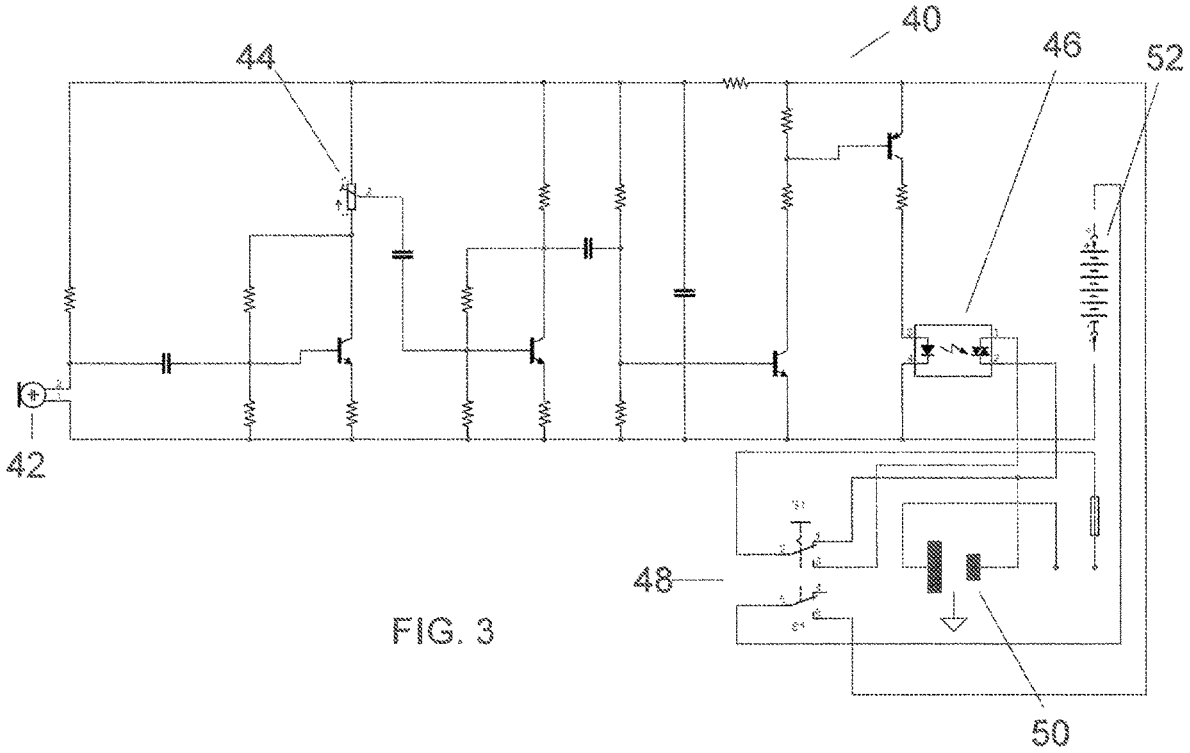
FIG. 3 is a schematic view of one illustrative embodiment of the electrical circuit that is contained within the housing of the sound conversion device shown in FIGS. 1-2, wherein a 9-volt battery powers the electrical circuit and microphone.
Figure 4:
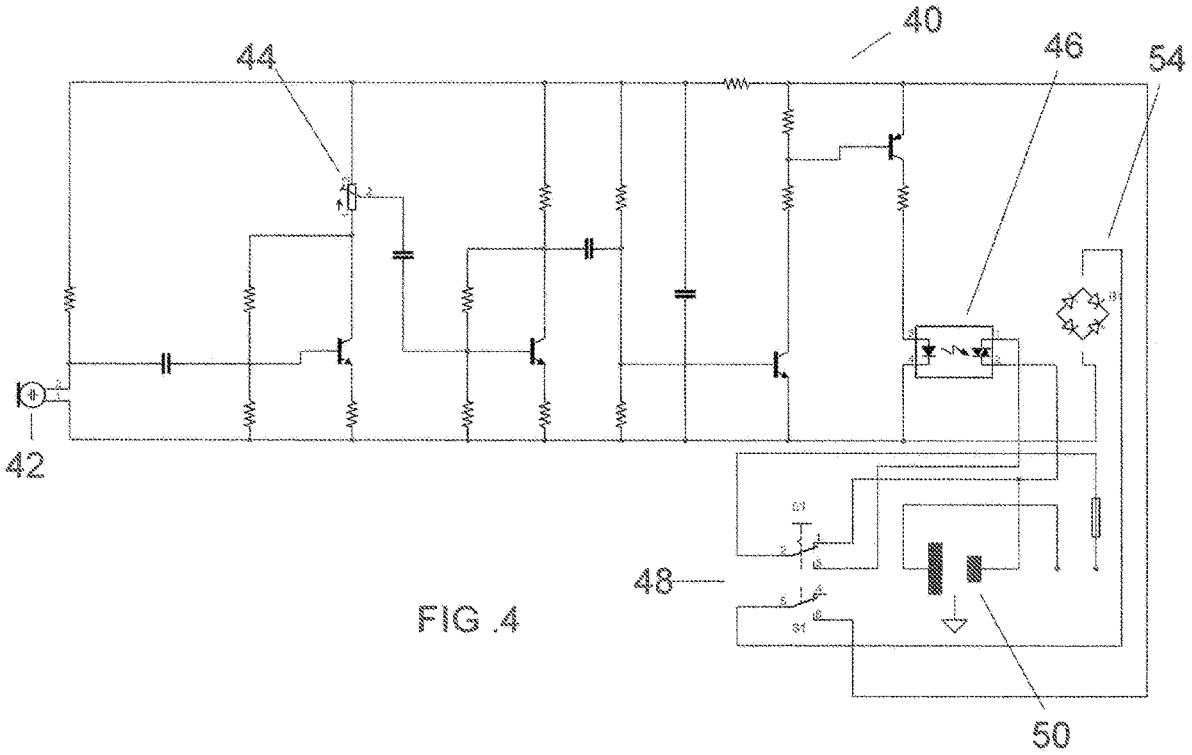
FIG. 4 is a schematic view of a second illustrative embodiment of the electrical circuit that is contained within the housing of the sound conversion device shown in FIGS. 1-2, wherein a rectifier powers the electrical circuit and microphone.

FIG. 3 is a schematic view of one illustrative embodiment of the electrical circuit 40 that contained within the housing of the sound conversion device shown in FIGS. 1-2. Electrical circuit 40 includes microphone 42 that receives and converts one or more audio signals into one or more first DC voltages. Electrical circuit 40 and microphone 42 are powered by a 9-volt battery 52. Electrical circuit 40 includes a sensitivity adjuster 44 to allow the intensity of the received audio signals to be adjusted. Electrical circuit 40 powers a relay switch such as a solid-state relay 46. The relay switch 46 is switched on and off in response to a plurality of received audio signals which create pulsating first DC voltage. When the relay switch 46 is switched on, or otherwise activated, it controls AC voltage or a second DC voltage which powers a light display (not shown) that is in electrical communication with electrical circuit 40 via electrical outlet 50. Electrical circuit 40 includes a switch 48 to interrupt or restore electric current.

FIG. 3 is a schematic view of one illustrative embodiment of the electrical circuit 40 that contained within the housing of the sound conversion device shown in FIGS. 1-2. Electrical circuit 40 includes microphone 42 that receives and converts one or more audio signals into one or more first DC voltages. Electrical circuit 40 and microphone 42 are powered by a rectifier 54. Electrical circuit 40 includes a sensitivity adjuster 44 to allow the intensity of the received audio signals to be adjusted. Electrical circuit 40 powers a relay switch such as a solid-state relay 46. The relay switch 46 is switched on and off in response to a plurality of received audio signals which create pulsating first DC voltage. When the relay switch 46 is switched on, or otherwise activated, it controls AC voltage or a second DC voltage which powers a light display (not shown) that is in electrical communication with electrical circuit 40 via electrical outlet 50. Electrical circuit 40 includes a switch 48 to interrupt or restore electric current.

While the sound conversion device, sound conversion electrical circuit, and methods for converting an audio signal have been described in connection with various embodiments, it is to be understood that other similar embodiments may be used or modifications and additions may be made to the described embodiments for performing the same function. Furthermore, the various illustrative embodiments may be combined to produce the desired results. Therefore, the sound conversion device, sound conversion electrical circuit, and methods for converting an audio signal should not be limited to any single embodiment.

It will be understood that the embodiments described herein are merely exemplary, and that one skilled in the art may make variations and modifications without departing from the spirit and scope of the invention. All such variations and modifications are intended to be included within the scope of the invention as described hereinabove. Further, all embodiments disclosed are not necessarily in the alternative, as various embodiments of the invention may be combined to provide the desired result.

The invention claimed is:

1. A sound conversion device comprising:

a housing, wherein at least one surface of the housing incorporates a 110-120 VAC outlet;

an electrical circuit for receiving and converting one or more audio signals into one or more DC voltages, wherein said electrical circuit comprises an optocoupler relay comprising a solid state relay for converting said one or more DC voltages into an AC voltage; and a light display in electrical communication with said electrical circuit that turns on and off in response to the one or more received audio signals; wherein said optocoupler relay is coupled to the 110-120 VAC outlet to permit said light display to be plugged into said sound conversion device.

2. The device of claim 1, wherein said electrical circuit further comprises a microphone to receive said one or more audio signals.

3. The device of claim 2, wherein said housing comprises an aperture to allow said one or more audio signals to be received by said microphone.

4. The device of claim 1, wherein said electrical circuit and/or microphone is powered by a battery.

5. The device of claim 4, wherein said electrical circuit and/or microphone is powered by a 9-volt battery.

6. The device of claim 1, wherein said electrical circuit and/or microphone is powered by a rectifier.

7. The device of claim 1, wherein said electrical circuit further comprises a fuse to protect from overloads and transients in electrical power.

8. The device of claim 7, wherein said fuse comprises a current-limiting fuse.

9. The device of claim 1, wherein at least one surface of said housing incorporates an outlet which permits a light display to be plugged into said sound conversion device.

10. The device of claim 1, wherein said electrical circuit further comprises a sensitivity adjuster, wherein a threshold value for converting the one or more received audio signals into one or more DC voltages is selectively controlled or adjusted by said sensitivity adjuster.

11. The device of claim 10, wherein said sensitivity adjuster comprises a trimmer.

12. The device of claim 11, wherein said trimmer comprises at least one of a variable resistor (potentiometer), variable capacitor or trimmable inductor.

13. The device of claim 1 further comprising a switch to interrupt or restore electric current.

14. The device of claim 1, wherein said housing comprises an integrated plug adapted to be inserted directly into an electrical outlet.

15. The device of claim 1, wherein said housing comprises electrical wiring terminating in a plug adapted to be connected to a source of electrical power.

16. The device of claim 1, wherein the sound conversion device is in electrical communication with a source of electrical power comprising at least 110V AC.

17. An electrical circuit that receives and converts one or more audio signals into one or more first direct current (DC) voltages, wherein said electrical circuit comprises an optocoupler relay comprising a solid state relay that is activated by one or more first DC voltages, wherein in its activated state the optocoupler relay provides an alternating current (AC) voltage that powers a light display in electrical communication with the electrical circuit, wherein the light display turns on and off in response to the one or more audio signals; wherein said optocoupler relay is coupled to a 110-120 VAC outlet to permit said light display to be plugged into a sound conversion device housing the electrical circuit.

* * * * *